United States Patent [19]

Quandt

[11] 4,306,166

[45] Dec. 15, 1981

[54] BEARING AND DRIVE ARRANGEMENT FOR AN OPEN-END SPINNING TURBINE

[75] Inventor: Gerhard Quandt, Heidelberg, Fed. Rep. of Germany

[73] Assignee: Teldix GmbH, Heidelberg, Fed. Rep. of Germany

[21] Appl. No.: 29,837

[22] Filed: Apr. 13, 1979

Related U.S. Application Data

[63] Continuation of Ser. No. 812,403, Jul. 1, 1977, abandoned.

[30] Foreign Application Priority Data

Jul. 3, 1976 [DE] Fed. Rep. of Germany ..... 2630031

[51] Int. Cl.[3] ..... H02K 5/16

[52] U.S. Cl. ..... 310/90; 310/266; 57/77; 308/9; 308/DIG. 1

[58] Field of Search ..... 310/90, 67, 93, 190, 310/66, 266, 46; 57/77, 100, 58.89; 308/9, DIG. 1

[56] References Cited

U.S. PATENT DOCUMENTS

| | | | |
|---|---|---|---|
| 2,849,630 | 8/1950 | Waloff | 310/266 |
| 3,512,021 | 5/1970 | Laurent | 310/67 R |
| 3,601,507 | 8/1971 | Harris | 310/67 R |
| 3,837,716 | 9/1974 | Allen | 308/9 |
| 3,974,406 | 8/1976 | Wehde | 310/67 R |
| 4,070,813 | 1/1978 | Quandt | 57/58.89 |
| 4,117,359 | 9/1978 | Wehde | 310/67 R |
| 4,128,280 | 12/1978 | Purtschert | 308/9 |

FOREIGN PATENT DOCUMENTS

| | | | |
|---|---|---|---|
| 506611 | 8/1930 | Fed. Rep. of Germany | 310/266 |

*Primary Examiner*—R. Skudy

*Attorney, Agent, or Firm*—Spencer & Kaye

[57] ABSTRACT

In a bearing and drive structure for the spinning rotor of an open-end spinning turbine in which the rotor is carried by an elastically mounted bearing, the structure including a stator having a portion disposed adjacent a portion of the stator; the stator and rotor portions together defining an electrical drive for the spinning rotor and being separated from one another by a motor air gap, the rotation of the rotor is stabilized by the provision of mutually facing, circumferentially extending surfaces on, respectively, the rotor and a stationary body adjacent the rotor and forming a stabilizing air gap smaller than the motor air gap.

9 Claims, 4 Drawing Figures

BEARING AND DRIVE ARRANGEMENT FOR AN OPEN-END SPINNING TURBINE

CROSS REFERENCE TO RELATED APPLICATION

This application is continuation of Applicant's copending U.S. application Ser. No. 812,403 filed July 1, 1977, now abandoned.

BACKGROUND OF THE INVENTION

The present invention relates to a bearing and drive structure for an open-end spinning turbine, the turbine including a spinning rotor mounted by means of at least one elastically suspended slide or roller bearing bush and drive for the rotor being provided by a motor presenting a narrow motor air gap between a rotor member utilized for the drive and a stator member disposed oppositely thereto and carrying stator windings.

Such a bearing and drive arrangement is disclosed in German Offenlegungsschrift [Laid-Open Application] No. 2,404,241 and corresponding U.S. application Ser. No. 695,551, filed by Heinz Wehde on June 14, 1976.

In addition to the above-mentioned motor air gap, the spinning turbine of the above-mentioned previously disclosed arrangement also has, of course, an air gap between the outer surface of the rotor and the stationary housing surrounding the rotor.

Such open-end spinning turbines are known to be subjected to forces which are created, during passage through the resonant frequency during the starting phase and during rotation at reduced speed, by imbalances as a result of the spinning operation and by the activities of operating personnel, e.g. during cleaning of the spinning rotor by means of a brush or the like when the turbine is slowing down. Because of the elastic bearing arrangement, this produces lateral deflections of the turbine and may lead to destruction of the parts in the rotor and/or stator required for the drive. Moreover, when the slide bearing bush becomes worn for the above-mentioned reasons, the rotor tends to experience a tumbling movement.

SUMMARY OF THE INVENTION

It is therefore an object of the present invention to prevent, in an elastically mounted spinning turbine with integrated drive of the above-described type, the destruction of the drive members and to reduce possible tumbling movement of the rotor.

These and other objects are accomplished, according to the present invention, by stabilizing the position of the rotor, by the provision of pairs of opposing surfaces, in a region between the rotor and the stator, arranged to produce an air gap smaller than the motor air gap.

It is not a prerequisite to the practice of the present invention that the motor have an external rotor such as shown in FIG. 1 of each of the above-cited prior applications. The only prerequisite is the presence of an elastic mounting.

The arrangement according to the present invention has a dual effect:

Firstly, the pair or pairs of surfaces form dynamic air bearings which, during operation, effect stabilization of the motion of the rotor. It is most advantageous, in this connection, to have the distance between the faces as small as possible. On the other hand, if the gap is too small, the manufacturing costs would increase due to the tolerance requirements. Moreover, the energy requirement of the motor would then be increased. A favorable compromise is achieved by a gap size of 0.2–0.4 mm.

Secondly, the pairs of surfaces simultaneously serve to prevent the rotor from experiencing any significant degree of tilting with respect to the stator, which could produce damage, e.g. during cleaning with the rotor speed running down. Only forces up to a certain magnitude can thus be imposed on the bearing. Therefore, the bearing itself is also protected.

A pair of surfaces can be arranged to extend over a substantial portion of the length of the rotor. However, two short pairs of surfaces spaced apart from one another are more advantageous with respect to energy requirements.

Pairs of surfaces according to the present invention can be spaced apart radially and/or axially. Radial spacing means that a pair of surfaces defines two opposing axially extending, radially separated cylinder faces with respectively different radii, the difference in radii constituting the gap size or width, while axial spacing means that a pair of surfaces defines two opposing radially extending annular faces which are separated axially by the width of the gap. It is also conceivable to have a pair of surfaces which are conical or curved in the axial direction.

In order to attain the above-mentioned protection of the bearing, the materials for the members defining the pairs of surfaces are selected correspondingly.

DESCRIPTION OF THE PREFERRED EMBODIMENTS

Figure 1:
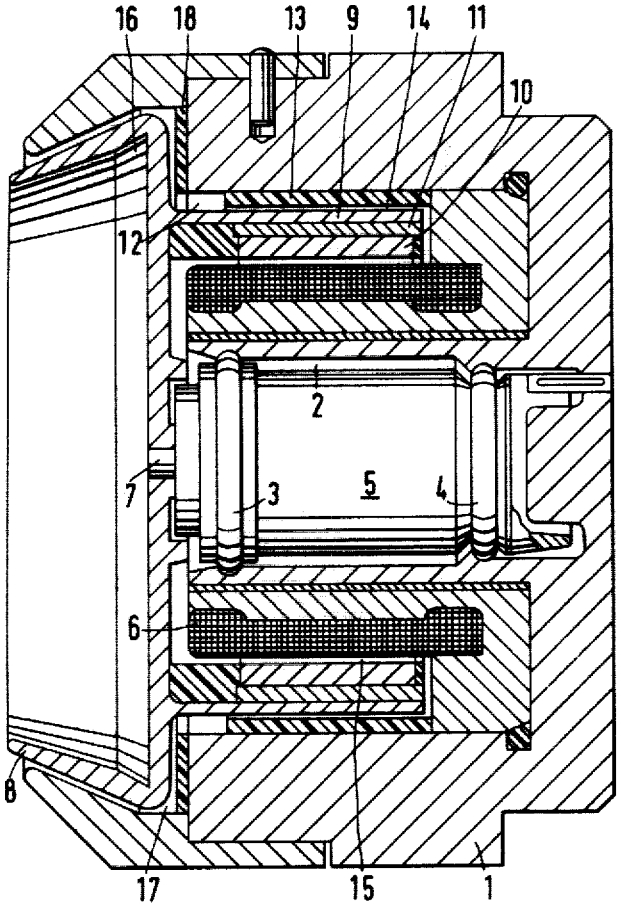
FIG. 1 is an elevational, cross-sectional view of a preferred embodiment of the invention having a radial pair of surfaces and an axial pair of surfaces.

The embodiment shown in FIG. 1 includes a stator 1, a bearing bush 5 elastically mounted in a bore 2 of the stator 1 by means of O-rings 3 and 4 and a stator motor winding 6 secured around the stator.

A thin shaft or pin 7 secured to the rotor projects into the bearing bush 5 to form a journal bearing therewith. This shaft 7 supports the spinning rotor 8 which has a funnel-like front end defining a trough 16 in which spinning takes place, and a cylindrical cup-shaped rotor part 9 which carries a conductive flux return ring 11 and radially magnetized, circumferentially distributed rotor magnets 10.

In the air gap 12 extending between the stator 1 and the cylindrical rotor part 9, there is placed a ring 13 which is fastened to the stator and which extends along a significant portion of the axial length of the rotor at a small distance of 0.3 mm from the outer surface of rotor part 9. The surfaces of part 9 and ring 13 bordering the resulting air gap 14, which is narrower than the motor air gap 15, form a dynamic air bearing which stabilizes the position of the rotor during rotation. If an asymmetrical force is applied during run-down of the rotor, for example by means of a cleaning brush pressed into groove 16, these surfaces limit the extent to which the rotor can tilt relative to the stator and thus act to prevent the rotor from being tilted too much with respect to the stator. Thus forces exceeding a certain magnitude are prevented from being imposed on the rotor journal bearing.

An annular disc 18 disposed in the air gap 17 between the funnel-shaped front end of the rotor and a facing surface of stator 1 serves to stabilize the rotor in the same manner as ring 13 and serves to protect the journal bearing, which is advantageous since O-rings 3 and 4 also permit a certain amount of axial displacement of bush 5. The air gap 17 may be between 0.5 and 0.6 mm.

Figure 2:
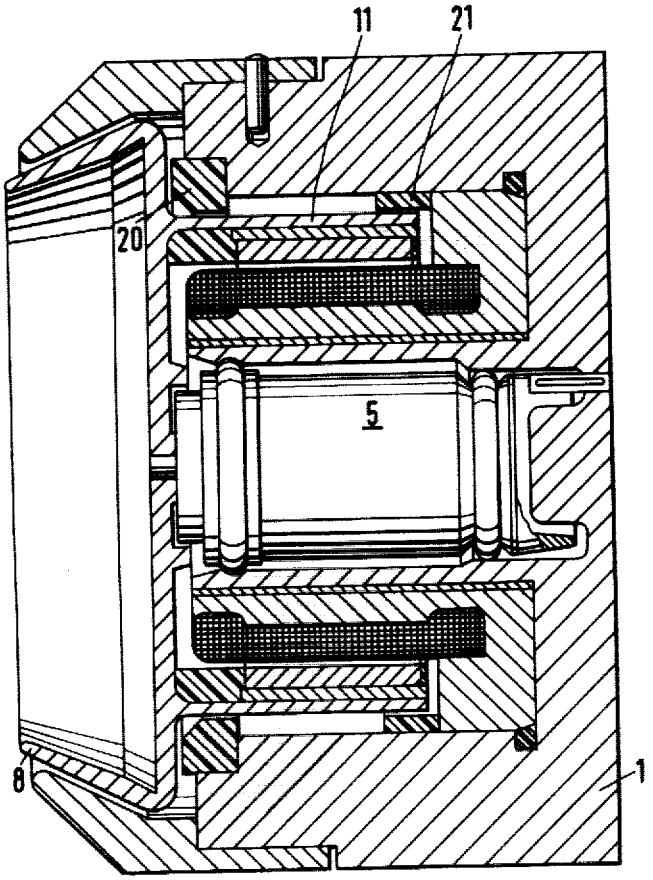
FIG. 2 is a view similar to that of FIG. 1 of a second preferred embodiment having two axial pairs of faces and one pair of surfaces at the frontal face.

In the embodiment shown in FIG. 2, two rings 20 and 21 are fastened to the stator, this embodiment being otherwise comparable to that of FIG. 1. These rings have comparatively short axially extending surfaces which are axially spaced from one another and which each faces the outer cylinder surface of rotor member 11. The inner cylindrical surface of each of rings 20 and 21 thus forms with the outer surface of rotor member 11 a respective dynamic air bearing and emergency-bearing. The term "emergency-bearing" signifies that the bearing surfaces can come in contact with one another to limit radial deflection of the rotating element, whereupon the bearing surfaces act as a slide bearing. Ring 20 is doubly utilized in that it has an axial end surface that forms an air bearing and an emergency-bearing with an associated surface of the front end of spinning rotor 8.

Figure 3:
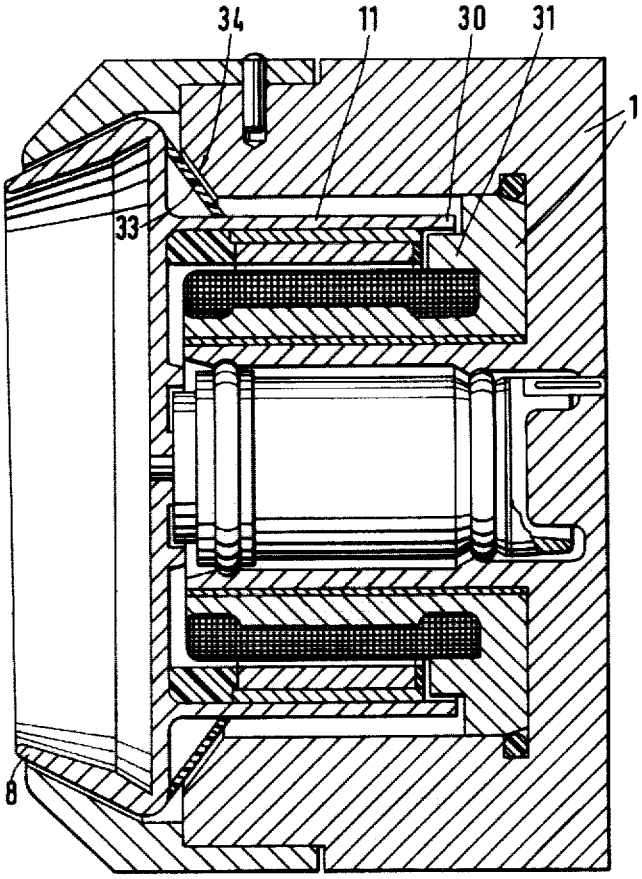
FIG. 3 is a view similar to that of FIG. 1 of a third preferred embodiment having a conical pair of surfaces and a radial pair of surfaces.

In the embodiment shown in FIG. 3, the cylindrical rotor member 11 is elongated toward the right, to form a portion 30, and portion 30 forms an air and emergency-bearing together with an outer cylindrical surface of an interiorly disposed stator portion 31. The spinning rotor carries a conically shaped part 33, or is itself given a conical shape at the same location. Member 33 forms an oblique air and emergency-bearing with a conical surface 34 of the stator which is parallel to the surface of conical member 33. This arrangement provides an emergency-bearing which is effective in both the axial and radial directions and creates both axial and radial stabilization components.

When the rotor is designed as an internal rotor, which is then mounted by means of two elastically mounted bearing points, the present invention can be used in the same manner.

Figure 4:
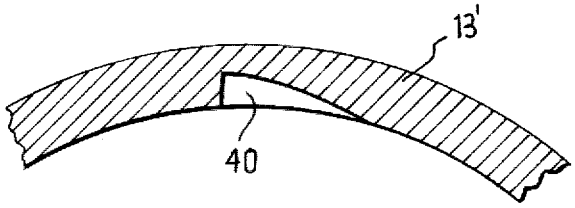
FIG. 4 is a view on a part of ring 13 of FIG. 1, having recesses.

The effect of the dynamic air bearing can be increased by the formation of recesses with a wedge-shaped depth profile in at least one of the surfaces of a pair defining such small air gap, as shown in FIG. 4. This FIG. 4 shows a part of ring 13 of FIG. 1 as 13' with one recess 40, the ring being cut by a plane perpendicular to the rotor axis.

The air-gaps in FIGS. 2 and 3 may have the same dimensions as the gaps 14 and 17 of FIG. 1.

The emergency-bearings for example of FIG. 1 consisting of ring 13 and part 9 and ring 18 and part of the rotor 8 are made of a combination of material, which is suitable to form a slide bearing in cases of larger deflections of the rotor. Suitable combination of material are a metal as aluminum or iron and coal or a suitable plastic such as fluorin-carboniferous resin (Teflon).

It will be understood that the above description of the present invention is susceptible to various modifications, changes and adaptations, and the same are intended to be comprehended within the meaning and range of equivalents of the appended claims.

What is claimed is:

1. In a bearing and drive structure for the spinning rotor of an open-end spinning turbine, which structure includes: a stationary support unit; a bearing bush rotatably supporting the spinning rotor; means elastically mounting the bearing bush to the support unit; and means defining an electrical drive for rotating the spinning rotor and including a rotor part forming a unit, and rotatable, with the spinning rotor and a stator disposed to define a motor-air gap with the rotor part the improvement comprising stabilization means defining at least one pair of surfaces constituted by a first surface which is stationary and a second surface rotatable together with said rotor part, facing said first surface and defining with said first surface an air gap which is smaller than said motor air gap and which forms, during rotation of said rotor, a dynamic air bearing for stabilizing the rotational movement of said spinning rotor and rotor part, and wherein said first surface surrounds said second surface.

2. An arrangement as defined in claim 1 wherein said first surface extends over a substantial portion of the axial dimension of said stator and said second surface is constituted by a face of said rotor part.

3. An arrangement as defined in claim 1 wherein said stabilization means define two pairs of said surfaces spaced from one another in the direction of the axis of rotation of said rotor part.

4. An arrangement as defined in claim 3 wherein said surfaces of one said pair are cylindrical surfaces which extend in the direction of the axis of rotation of said rotor part and which are spaced from one another in the radial direction, the said surfaces of the other said pair extend in the radial direction and are spaced from one another in the direction of the axis of rotation of said rotor part.

5. An arrangement as defined in claim 1 wherein said first and second surfaces are cylindrical surfaces which extend in the direction of the axis of rotation of said rotor part and which are spaced from one another in the radial direction.

6. An arrangement as defined in claim 1 wherein said first and second surfaces extend radially of the axis of rotation of said rotor part and are spaced from one another in the direction of that axis.

7. An arrangement as defined in claim 1 wherein said first and second surfaces are conical annular surfaces coaxial with the axis of rotation of said rotor part.

8. An arrangement as defined in claim 1 wherein said means defining said first and second surfaces are of slide bearing materials.

9. An arrangement as defined in claim 1 wherein one of said first and second surfaces is provided with a wedge-shaped groove.

* * * * *